US012083379B2

(12) United States Patent
Nørgaard Johansen

(10) Patent No.: US 12,083,379 B2
(45) Date of Patent: Sep. 10, 2024

(54) MULTI-FUNCTIONAL TRAINING APPARATUS

(71) Applicant: Kompan A/S, Odense (DK)

(72) Inventor: Martin Nørgaard Johansen, Odense (DK)

(73) Assignee: Kompan A/S, Odense SØ (DK)

( * ) Notice: Subject to any disclaimer, the term of this patent is extended or adjusted under 35 U.S.C. 154(b) by 233 days.

(21) Appl. No.: 17/754,119

(22) PCT Filed: Sep. 28, 2020

(86) PCT No.: PCT/EP2020/077102
§ 371 (c)(1),
(2) Date: Mar. 24, 2022

(87) PCT Pub. No.: WO2021/058820
PCT Pub. Date: Apr. 1, 2021

(65) Prior Publication Data

US 2022/0331649 A1 Oct. 20, 2022

(30) Foreign Application Priority Data

Sep. 27, 2019 (DK) ..... PA201970607

(51) Int. Cl.
*A63B 22/00* (2006.01)
*A63B 22/06* (2006.01)

(52) U.S. Cl.
CPC ..... *A63B 22/001* (2013.01); *A63B 22/0664* (2013.01); *A63B 2022/067* (2013.01)

(58) Field of Classification Search
CPC ..... A63B 22/001; A63B 22/0664; A63B 2022/067; A63B 23/12; A63B 22/0048;
(Continued)

(56) References Cited

U.S. PATENT DOCUMENTS 3,824,994 A 7/1974 Soderberg, Sr.
6,063,008 A * 5/2000 McBride ..... A63B 22/0664 482/52

(Continued)

FOREIGN PATENT DOCUMENTS

EP 0966990 A1 12/1999
EP 1004332 A2 5/2000

(Continued)

OTHER PUBLICATIONS

Danish Search Report issued in Denmark Patent Application No. PA 2019 70607 on Feb. 27, 2020 (1 page).

(Continued)

*Primary Examiner* — Garrett K Atkinson
(74) *Attorney, Agent, or Firm* — Bookoff McAndrews, PLLC

(57) ABSTRACT

A multi-functional training apparatus comprises a first floating beam, a second floating beam, a rear portion of the first floating beam being connected to a rotating member at a first point and a rear portion of the second floating beam being connected to a rotating member at a second point, the first and second points being arranged on opposing sides of a plane passing through the rotational axis of the rotating member, a forward portion of the first floating beam being connected to a lower portion of a first pivoting beam and a forward portion of the second floating beam being connected to a lower portion of a second pivoting beam, a first and second moving handle being connected to the first and second pivoting beams respectively, a first foot plate arranged on the first floating beam, a second foot plate arranged on the second floating beam.

13 Claims, 4 Drawing Sheets

(58) Field of Classification Search
CPC ..... A63B 21/225; A63B 2208/0204; A63B 2022/0676
See application file for complete search history.

(56) References Cited

U.S. PATENT DOCUMENTS

| | | | | |
|---|---|---|---|---|
| 6,171,217 | B1 | 1/2001 | Cutler | |
| 6,551,217 | B2 * | 4/2003 | Kaganovsky | A63B 22/0605 482/57 |
| 7,022,049 | B2 * | 4/2006 | Ryan | A63B 22/0664 482/52 |
| 7,037,242 | B2 * | 5/2006 | Lo | A63B 22/0664 482/52 |
| 7,276,017 | B2 * | 10/2007 | Chen | A63B 22/001 482/52 |
| 7,594,877 | B2 * | 9/2009 | Anderson | A63B 22/001 482/52 |
| D615,604 | S | 5/2010 | Keiser | |
| 7,771,324 | B2 * | 8/2010 | Anderson | A63B 21/157 482/52 |
| 7,811,206 | B2 * | 10/2010 | Chuang | A63B 22/0664 482/52 |
| 7,918,766 | B2 * | 4/2011 | Lu | A63B 22/001 482/52 |
| 8,808,149 | B2 * | 8/2014 | Huang | A63B 22/0664 482/52 |
| 8,840,529 | B2 * | 9/2014 | Chen | A63B 22/0664 482/52 |
| 8,870,716 | B2 * | 10/2014 | Murray | A63B 21/15 482/52 |
| 8,936,535 | B1 * | 1/2015 | Chen | A63B 22/001 482/52 |
| 9,067,101 | B1 * | 6/2015 | Chuang | A63B 22/001 |
| 9,254,414 | B2 * | 2/2016 | Liu | A63B 22/208 |
| 9,474,925 | B1 | 10/2016 | Hsiung | |
| 9,498,674 | B2 * | 11/2016 | Zhou | A61B 5/222 |
| 9,925,411 | B2 * | 3/2018 | Huang | A63B 22/0664 |
| 10,369,404 | B2 * | 8/2019 | Smith | A63B 22/001 |
| 2003/0013581 | A1 * | 1/2003 | Kaganovsky | A63B 22/0664 482/51 |
| 2004/0162191 | A1 | 8/2004 | Ercanbrack et al. | |
| 2005/0209057 | A1 | 9/2005 | Wang et al. | |
| 2007/0015633 | A1 | 1/2007 | Gerschefske et al. | |
| 2007/0072742 | A1 * | 3/2007 | Chen | A63B 22/001 482/52 |
| 2007/0087904 | A1 | 4/2007 | Yang et al. | |
| 2007/0161464 | A1 * | 7/2007 | Chiles | A63B 22/0664 482/52 |
| 2008/0076639 | A1 | 3/2008 | Fon | |
| 2008/0242516 | A1 * | 10/2008 | Lu | A63B 22/001 482/52 |
| 2009/0156368 | A1 | 6/2009 | Ketomaki | |
| 2010/0248899 | A1 * | 9/2010 | Bedell | A63B 22/001 482/4 |
| 2011/0082014 | A1 * | 4/2011 | Leonhard | A63B 21/0052 482/57 |
| 2014/0080676 | A1 | 3/2014 | Wang | |
| 2014/0371032 | A1 * | 12/2014 | Peng | A63B 22/001 482/52 |
| 2015/0087481 | A1 * | 3/2015 | Liu | A63B 22/0015 482/52 |
| 2015/0283425 | A1 * | 10/2015 | Zhou | A63B 22/0005 482/56 |
| 2017/0128771 | A1 * | 5/2017 | Huang | A63B 22/04 |

FOREIGN PATENT DOCUMENTS

| | | | |
|---|---|---|---|
| EP | 2191873 | A1 | 6/2010 |
| WO | 2004108223 | A1 | 12/2004 |
| WO | 2004110566 | A1 | 12/2004 |

OTHER PUBLICATIONS

International Search Report and Written Opinion issued in International Application PCT/EP2020/077102 on Dec. 14, 2020 (9 pages).
Communication issued in corresponding European Application No. 20781362.7, issued May 10, 2024.

* cited by examiner

MULTI-FUNCTIONAL TRAINING APPARATUS

CROSS-REFERENCE TO RELATED APPLICATION(S)

This patent application is the U.S. National Stage entry under 35 U.S.C. § 371 of International Patent Application No. PCT/EP2020/077102, filed on Sep. 28, 2020, which claims the benefit of priority to Denmark Patent Application No. PA 2019 70607, filed on Sep. 27, 2019, the entirety of which is incorporated herein by reference.

The current invention relates to a multi-functional training apparatus comprising a first floating beam, a second floating beam, a rear portion of the first floating beam being connected to a rotating member at a first point and a rear portion of the second floating beam being connected to a rotating member at a second point, the first and second points being arranged on opposing sides of a plane passing through the rotational axis of the rotating member, a forward portion of the first floating beam being connected to a lower portion of a first pivoting beam and a forward portion of the second floating beam being connected to a lower portion of a second pivoting beam, a first and second moving handle being connected to the first and second pivoting beams respectively such that the first and second moving handles pivot synchronized with the motion of the pivoting beams, a first foot plate arranged on the first floating beam, a second foot plate arranged on the second floating beam, and the multi-functional training apparatus being arranged such that the first and second foot plates each move along an essentially elliptical path arranged on a vertical plane.

DESCRIPTION OF RELATED ART

The physical training apparatus as disclosed in the opening paragraph is well known in the art as is typically called an elliptical trainer or a cross trainer. The user stands on the foot plates, holds onto the first and second moving handles and starts the foot plates moving in a roughly elliptical path while moving the handles back and forth. The foot plates and the handles are linked together via the floating beams and pivoting beams so that the motion of the foot plates and the handles are synchronized. In this way, the user exercises both the upper and lower body at the same time. This is a great cardio exercise.

Some examples of known training apparatus are provided in US 2014/080676, US2005/5209057, US 2007/0087904 A1, US 2008/0076639 A1, US 2014/0371032, US D615604S, WO 2004/108223 A1 and US 2007/0015633. Some examples of other elliptical trainers without moving handles are disclosed in EP0966990, U.S. Pat. No. 6,063,008, EP1004332, EP2191873, U.S. Pat. No. 6,171,217 and WO04110566. However, as will be known to the person who frequents fitness centres, there are many different types of physical exercises and therefore many different types of physical training apparatuses available. Typically different exercises are provided on different machines.

SUMMARY OF THE INVENTION

It is a first aspect of the current invention to provide a physical training apparatus which can be used in multiple different modes to train different exercises.

This aspect is provided at least in part by a training apparatus as mentioned in the opening paragraph which further comprises the features of the characterizing portion of claim 1. In this way, a training apparatus is provided with a first mode which is more focussed on normal cardio training and a second mode which is more focussed on high interval training similar to sprint training.

The second mode is very comfortable when leaning on to the stationary handle assembly and can therefore be used for longer periods of time in this position. It gives a very good running/sprinting impression. By leaning over in this lower position, the hamstrings and gluteus maximus are activated for a more focused exercise on these muscle groups.

For the sake of this specification, when terms of orientation are used, these should be in reference to the orientation of a user using the apparatus in a normal way. For example, the "rear" part of the floating beam would be located behind the user when the user is using the apparatus in the normal way.

According to this specification, the elbow or forearm rest portions should be understood as portions on which the user can rest his or her forearms or his or her elbows during training over the length of a typical training session. Such sessions could last over 10 minutes, in certain cases over 20 minutes and the forearm or elbow rests should therefore allow resting a users weight on them for this entire period of time. It should be clear that prior art training apparatus will be known which have portions on which a user can rest his or her elbows or forearms. However, such portions will not be designed to support the weight of the user via the user's forearms or elbows over a longer period of time as will be the case during a normal training session and will as such not be considered as elbow or forearm rest portions In one embodiment, the forearm or elbow rest portions comprise a padded portion. In one embodiment, the forearm or elbow rest portions are formed with a flat or concave upper surface to support the elbows or forearms of the user in a stable position laterally. In one embodiment, the forearm or elbow rest portions are arranged with a convex upper surface. In one embodiment, the forearm or elbow rest portions are arranged to be soft so as to adapt to the shape of the users forearms or elbows to hold the forearms or elbows stably in place. In one embodiment, the elbow or forearm rest portions are combined into a single connected rest portion.

In one embodiment, the elbow or forearm rest portions are arranged at or ahead of the rearmost position of the first and second moving handles. In one embodiment, the rearmost portion and/or the central portion of the elbow or forearm rest portions is arranged at or ahead of the rearmost position of the first and second moving handles. In one embodiment, the elbow or forearm rest portions are arranged at or ahead of the point of rotation of the first and second moving handles.

In one embodiment, the stationary handle portion comprises a secondary holding portion which is arranged behind the elbow or forearm rest portions. In one embodiment, the stationary handle portion comprises a secondary holding portion which is arranged behind the centre point of the first and second moving handles.

In one embodiment, the main holding portion is arranged below the uppermost portion of the first and second moving handles.

In one embodiment, the main holding portion is arranged such that the ratio of a) the vertical distance between an upper portion of the main holding portion and the rear portion of one of the foot plates in its rearmost position to b) the horizontal distance between the upper portion of the main holding portion and the rear portion of the foot plate in its rearmost position is less than 1. In one embodiment, the ratio is less than 0.95 or less than 0.9.

In one embodiment, the maximum horizontal width of the main holding portion is less than the minimum horizontal distance between the first and second moving handles. In one embodiment, the minimum horizontal distance between the first and second moving handles at the height of the main holding portion is greater than 500 mm.

In one embodiment, the foot plates have a first surface which is essentially parallel to the longitudinal axis of the floating beam to which the foot plates is connected. In one embodiment the first surface has an average normal vector which is between 80 and 90 degrees to the longitudinal axis of the beam.

In one embodiment, the foot plates comprise a second surface, said second surface arranged behind the first surface and said second surface forming an angle (A) of between 110 and 160 degrees to the first surface. In one embodiment, the second surface forms an angle of between 120 and 160 degrees, between 120 and 150 degrees or between 130 and 150 degrees. In one embodiment, the first surface has a greater area than the second surface. In one embodiment, the second surface has an area of at least 5, at least 7 or at least 10 $cm^2$.

In one embodiment, the rotation of the rotating member is resisted by a controlled variable resistance device. IN this way, a controlled load profile can be applied to the apparatus. In one embodiment, the load is provided by an electric DC motor connected to the rotating member via a gear. In one embodiment, the electric DC motor is connected to a PWM controlled resistor where the pulse width controls whether or not the resistor is connected to the DC motor or not.

It should be emphasized that the term "comprises/comprising/comprised of" when used in this specification is taken to specify the presence of stated features, integers, steps or components but does not preclude the presence or addition of one or more other features, integers, steps, components or groups thereof.

Figure 1:
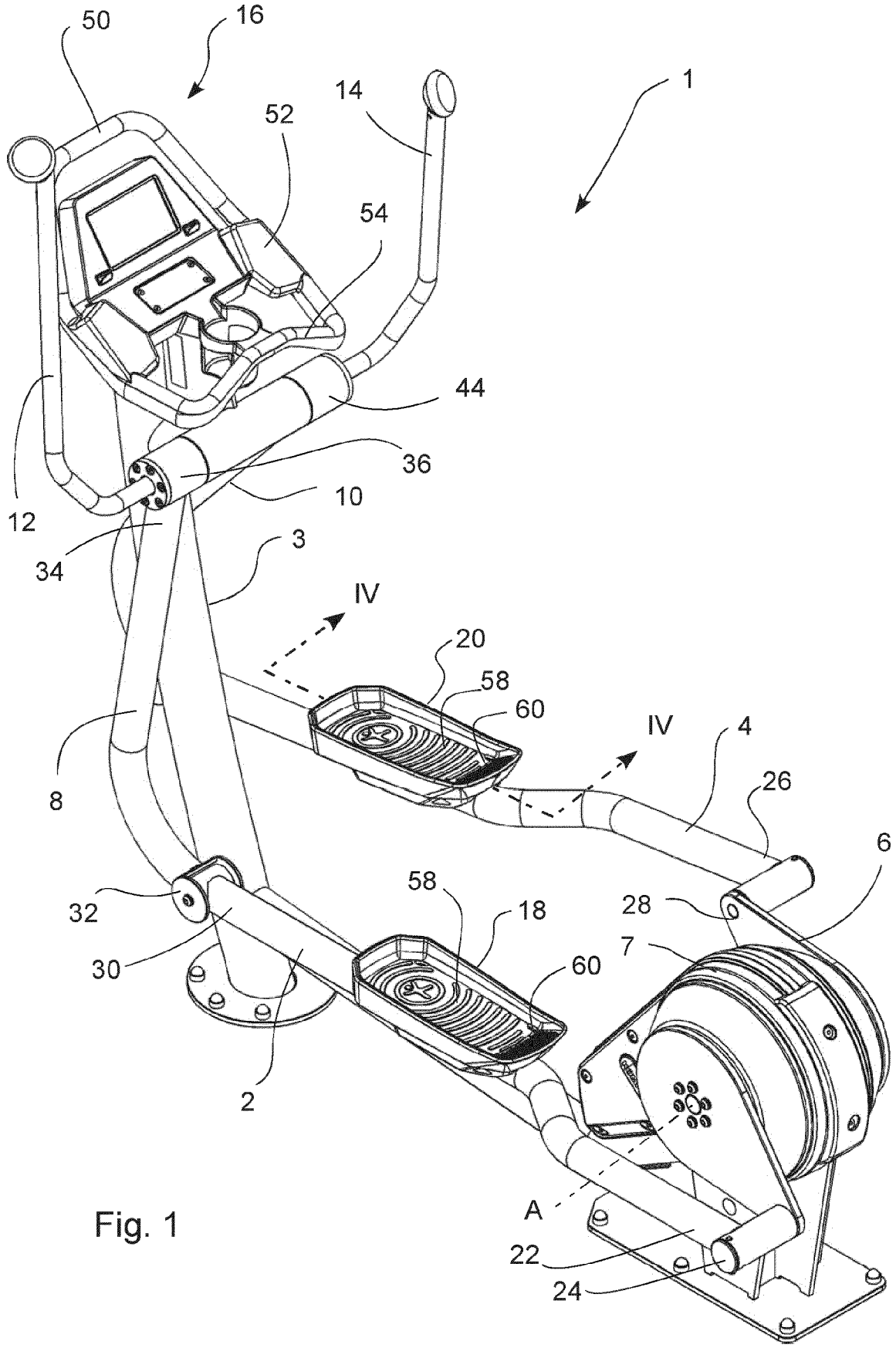
FIG. 1 shows a perspective view of a first embodiment of a multi-functional training apparatus according to the current invention.

In the following, the invention will be described in greater detail with reference to embodiments shown by the enclosed figures. It should be emphasized that the embodiments shown are used for example purposes only and should not be used to limit the scope of the invention.

DETAILED DESCRIPTION OF THE EMBODIMENTS

FIGS. 1 to 5 show different views of a first embodiment 1 of a physical training apparatus according to the current invention.

The physical training apparatus 1 comprises a frame 3, a first floating beam 2, a second floating beam 4, a rotating member 6, a resistance providing device 7, a first pivoting beam 8, a second pivoting beam 10, a first handle 12, a second handle 14 and a stationary handle assembly 16. A first foot plate 18 and a second foot plate 20 are fixed to an upper surface of the first and second floating beams respectively.

A first (rear) end 22 of the first floating beam 2 is connected to a first point 24 on the rotating member 6. A first end 26 of the second floating beam 4 is connected to a second point 28 on the rotating member. The first and second points are arranged on either side of a plane passing through the rotational axis A of the rotating member 6. As the rotating member rotates, the first and second points will rotate around the rotational axis A of the rotating member, likewise moving the first ends of the first and second floating beams around the rotational axis of the rotating member. The rotating member 6 is fixed to the frame 3 and some form of controllable resistance device 7 is attached to the rotating member to provide a controllable resistance against the motion by the user. As controllable resistance devices are known in the art, this will not be discussed in more details here.

A second (front) end 30 of the first floating beam 2 is attached to a lower portion 32 of the first pivoting beam 8. An upper portion 34 of the first pivoting beam is pivotably attached to the frame 3 of the training apparatus at a first pivot point 36. A second end 38 of the second floating beam 4 is attached to a lower portion 40 of the second pivoting beam 10. An upper portion 42 of the second pivoting beam is pivotably attached to the frame 3 of the training apparatus at a second pivot point 44.

In this embodiment, the first handle 12 is attached to the first pivoting beam 8 so that when the first pivoting beam pivots, the first handle also pivots. The same is true for the second handle 14, which is attached to the second pivoting beam 10. The first and second handles are arranged above the first and second pivot points 36, 44 respectively. In this way, as the pivoting beam moves forward the handle moves backwards and vice versa.

In general, this is the traditional method of operation of a typical elliptical trainer and as such will not be described in more detail here. However, it can be mentioned that in general, the floating beams will move forward and backwards during operation. As the floating beams move forwards, the rotating member will rotate as well causing the rear portion of the floating beam to move up and down in addition to forwards and backwards. In general, the foot plates will follow a roughly elliptical path as the user operates the machine. The apparatus will typically be arranged such that said first and second floating beams are arranged to move along an essentially elliptical path with a major axis arranged on an essentially horizontal plane and the first and second pivoting beams are arranged to pivot about an essentially horizontal axis, The apparatus will also typically be arranged such that said first and second floating beams and said pivoting beams are arranged such that when the floating beams move, the pivoting beams pivot.

Figure 2:
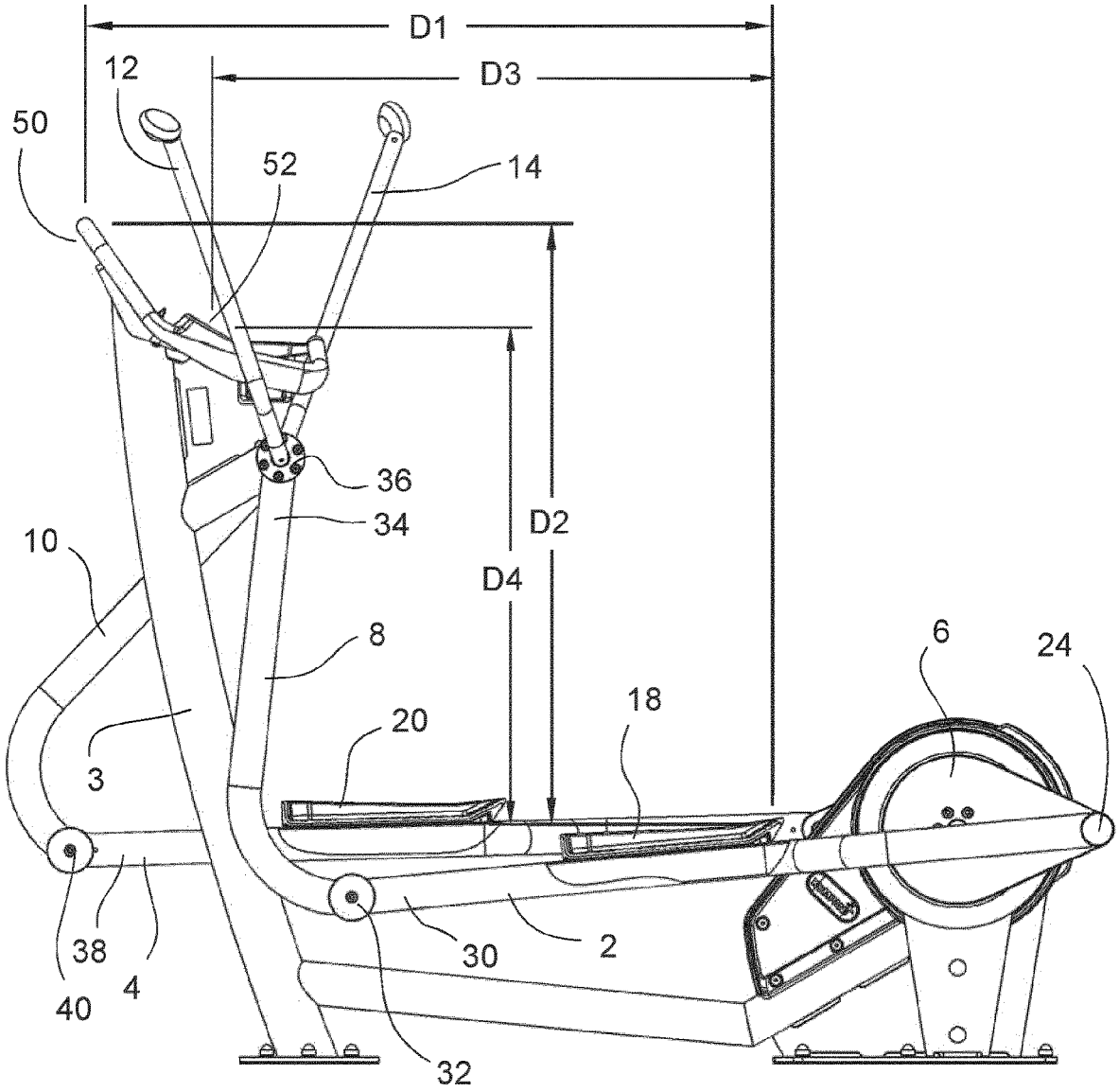
FIG. 2 shows a side view of the multi-functional training apparatus of FIG. 1 where one foot plate is in its rearmost position.
Figure 3:
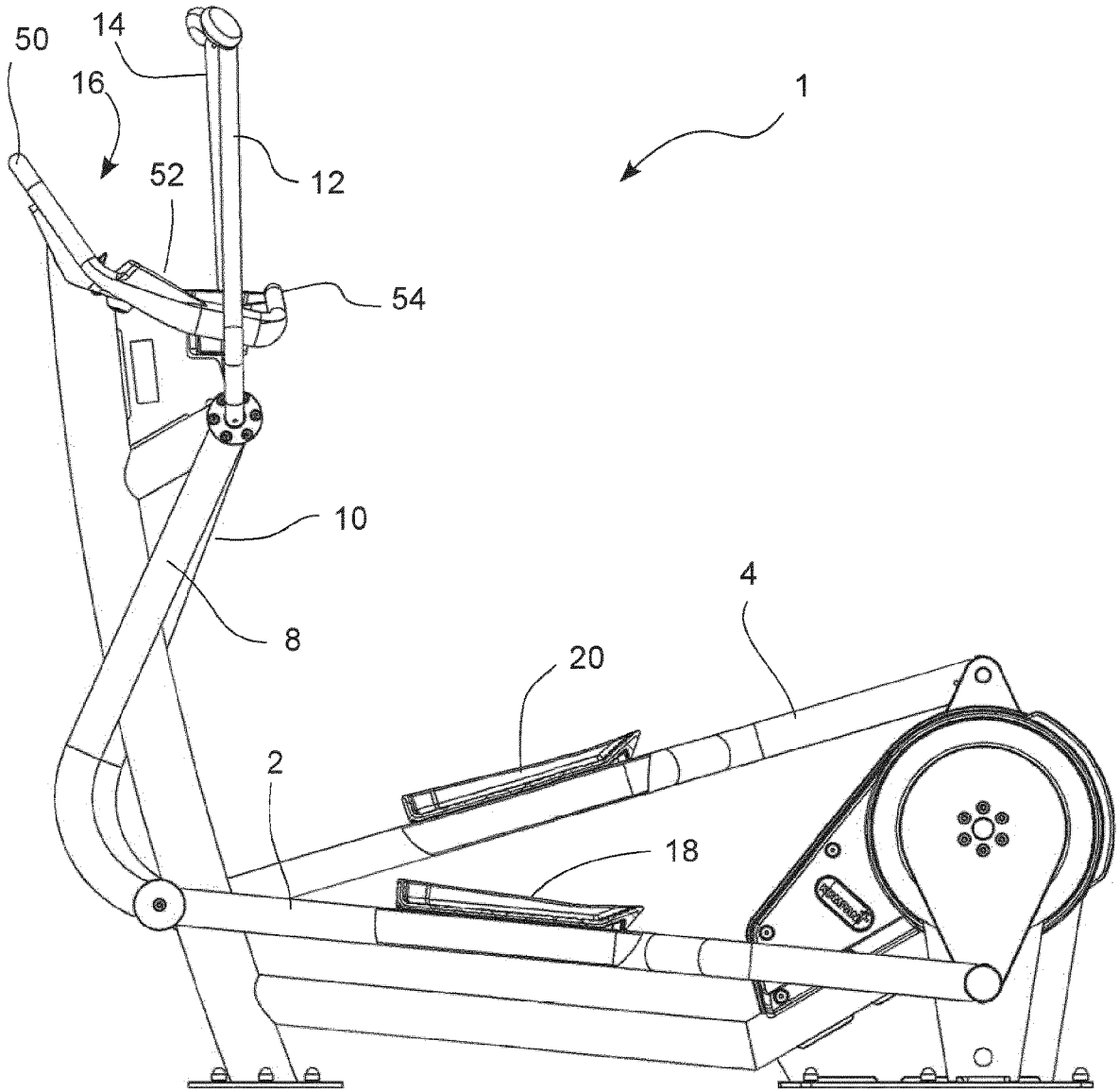
FIG. 3 shows a side view of the multi-functional training apparatus of FIG. 1 where the two foot plates are in their middle position.
Figure 4:
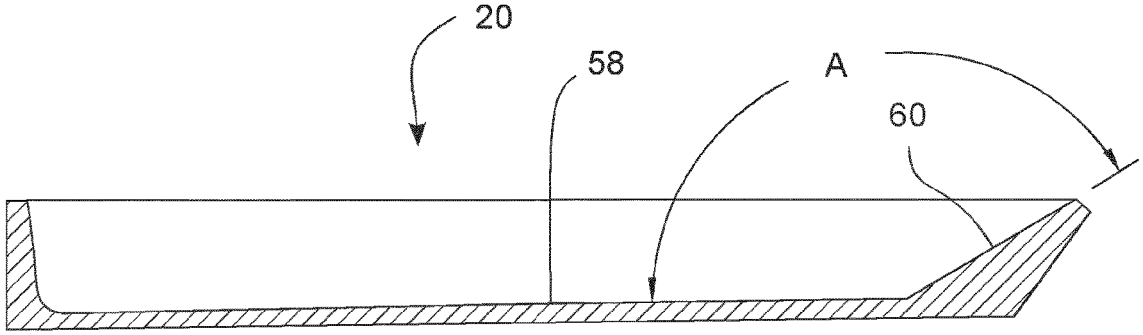
FIG. 4 shows a schematic cross sectional view through one of the foot plates according to the line IV-IV as defined in FIG. 1.

FIGS. 2 and 3 show side views of the apparatus 1 in two different positions. In FIG. 2, the apparatus is shown with the first foot plate 18 in its most rearward position. Likewise the second foot plate 20 is shown in its most forward position. Typically a forward walking motion is simulated and as such the rotating member rotates in a counter clockwise direction when viewing the rotating member according to the view of FIG. 2. As the apparatus continues to move, the first foot plate 18 will start to move forward and upwardly and the second foot plate 20 will start to move rearwards and downwardly. It can also be noted that the first and second handles 12, 14 act oppositely to the foot plates 18, 20. In the position shown in FIG. 2, the first handle 12 is in its most forward position and the second handle 14 is in its most rearward position.

FIG. 3 shows the apparatus in the position where the first foot plate 18 is in its lowest position and the second foot plate 20 is in its highest position. As the apparatus continues to move, the first foot plate 18 will move rearwards and upwards and the second foot plate 20 will move forwards and downwards.

It is of course also possible to "walk backwards" with the machine, then the motions will be reversed with respect to the discussion above.

In addition to the traditional elliptical trainer features of the apparatus shown in the figures, the apparatus also comprises a stationary handle assembly 16. In this embodiment, the stationary handle assembly comprises a main holding portion 50, a forearm resting portion 52 and a secondary holding portion 54. The main holding portion 50 is arranged ahead of the forearm resting portion which is ahead of the secondary holding portion 54. The main holding portion is arranged as a tubular structure onto which the user can grip with his or her hands. In this embodiment, the main holding portion comprises two tubes one extending forward from each of the forearm resting portions. The two tubes are connected by a horizontally arranged tube at the forward end of the tubes.

The forearm resting portion is a foam padded resting surface so that the user can rest his or her forearms on the forearm resting portions during the exercise. The foam padding compresses slightly when the user applies his or her weight and the padding will hold the user's forearms in place. In another embodiment (not shown), instead of providing portions for supporting the forearms, portions which support the users elbows could be provided instead. In another embodiment, instead of providing a foam padding, a smooth rubbery surface could be provided instead which provides a frictional hold for the forearms or elbows of the user. In this embodiment, the secondary holding portion is also arranged as a tubular structure.

During use, the user will operate the apparatus in one of two modes. A first mode is a cardio mode where the user will hold onto the first and second handles and place his or her feet on the foot plates. The user will then simultaneously move the foot plates and the handles to cause the rotating member to rotate. The resistance device will provide resistance to the rotating member to force the user to exert energy to keep the rotating member rotating. In this first mode, the user can also hold onto the secondary holding portion in case the user wants to rest his or her upper body.

In a second mode, the user rests his or her forearms on the forearm resting portion and holds onto the main holding portion 50 of the stationary handle assembly 16. This brings the user's body into a more horizontal position, less upright, and the user will then push the foot plates alternatively backwards. In this case, the resistance unit can be arranged to provide a greater resistance and the user will need to exert greater force and will have a more strength focussed exercise. In this way, the apparatus can be switched between a cardio focussed exercise and a more sprint/interval training focussed exercise.

As can be seen from FIGS. 1-4, the foot plates have a first surface 58 which is arranged essentially parallel to the longitudinal axis of the floating beams. This surface is the main surface of the foot plate and is large enough to support the foot sole of normal users of the apparatus when in the first mode. However, to allow the users to more effectively push the foot plates backwards in the second mode of operation, the foot plates are also provided with a second surface 60 towards the rear portion of the foot plate. This second surface is inclined at an angle of around 25 degrees to the first surface and allows the user to put his or her toes on the second surface and push backwards with more force. Typical prior art elliptical trainers will have foot plates which are similar to the foot plates of the figures, but where the rear portion of the foot plate is either flat or has a vertical flange extending from the first surface. In these prior art cases, it is uncomfortable or difficult to apply a force pushing the foot plates backwards.

For the sake of this specification, the position where the first foot plate or the second foot bed are in their rearmost positions is interesting for the sake of defining certain aspects of certain embodiments of the invention. In FIG. 2, a horizontal dimension D1 is shown from the rearmost portion 60 of the first foot plate (in its rearmost position) to the main holding portion 50 of the stationary handle assembly 16. Likewise a vertical dimension D2 is shown from the rearmost portion 60 of the first foot plate (in its rearmost position) to the main holding portion of the stationary handle assembly. In the concrete example, the dimension D1 is 1.216 m and the dimension D2 is 1.078 m. The ratio of D2 to D1 is around 0.88. Most typical elliptical trainers also have stationary handles, but typically these handles are arranged behind the moveable handles. As such, the ratio of D2 to D1 will be greater than 1 for most known elliptical trainers.

For the sake of completeness, the horizontal dimension from the rearmost portion of the foot plate (in its rearmost position) to the forearm rest portion could be called D3 and the vertical dimension from the rearmost portion of the foot plate (in its rearmost position) to the forearm rest portion could be called D4. In this concrete embodiment D3 is 0.97 m and D4 is 0.884 m. As such the ratio of D4 to D3 is around 0.91. Again typical elliptical trainers will not have any forearm rest portions. If they do have something to rest on these will typically be much further back and then the ratio of D4 to D3 would also be greater than 1.

Figure 5:
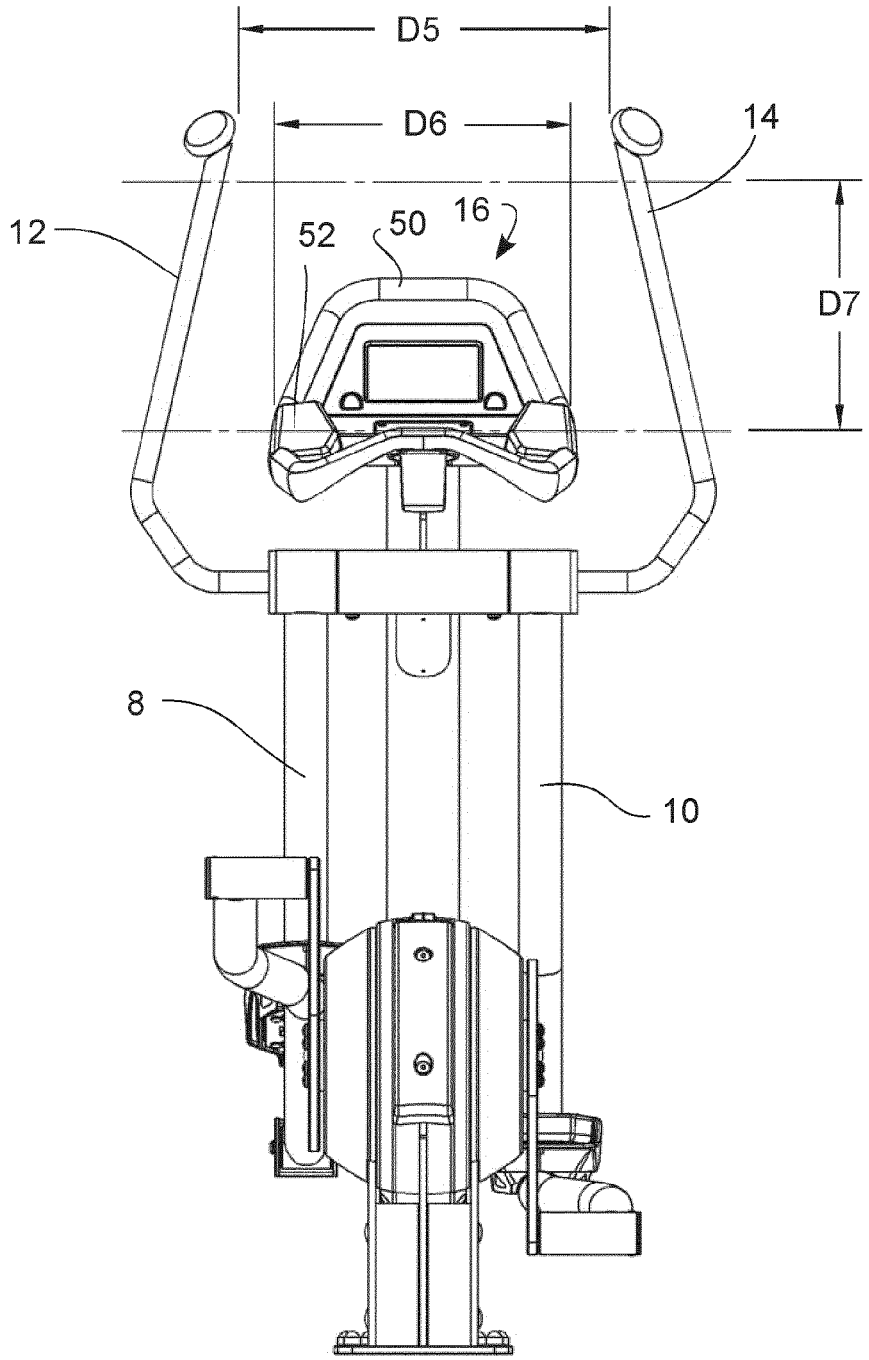
FIG. 5 shows a rear view of the multi-functional training apparatus of FIG. 1.

From FIG. 5, it can also be seen that the minimum horizontal dimension between the first and second handles is D5 and the maximum horizontal dimension of the stationary handle assembly is D6. D5 is greater than D6. In particular D5 should be greater than the width of the shoulders of the users. In one embodiment, the dimension D5 should be greater than 500 mm. In the current embodiment, the vertical distance between the gripping portion of the first and second handles and the forearm rest portions is D7. In one embodiment the dimension D7 is greater than 350 mm.

It is to be noted that the figures and the above description have shown and described the example embodiments in a sometimes simple and schematic manner. Many of the specific mechanical details have not been shown since the person skilled in the art should be familiar with these details and they would just unnecessarily complicate this description. For example, the specific materials used and the specific manufacturing procedures have not been described in detail since it is maintained that the person skilled in the art would be able to find suitable materials and suitable processes to manufacture the apparatus according to the current invention.

The invention claimed is:

1. A multi-functional training apparatus comprising a. a first floating beam, b. a second floating beam, c. a rear portion of the first floating beam being connected to a rotating member at a first point and a rear portion of the second floating beam being connected to the rotating member at a second point, the first and second points being arranged on opposing sides of a plane passing through the rotational axis of the rotating member, d. a forward portion of the first floating beam being connected to a lower portion of a first pivoting beam and a forward portion of the second floating beam being connected to a lower portion of a second pivoting beam, e. a first and second moving handle being connected to the first and second pivoting beams respectively such that the first and second moving handles pivot synchronized with the motion of the pivoting beams, f. a first foot plate arranged on the first floating beam, g. a second foot plate arranged on the second floating beam, and h. the multi-functional training apparatus being arranged such that the first and second foot plates each move along an essentially elliptical path arranged on a vertical plane, i. wherein the multi-functional training apparatus further comprises a stationary handle assembly, said stationary handle assembly comprising a main holding portion arranged in front of and between the first and second moving handles and an elbow or a forearm rest portion on either side of the stationary handle assembly about a vertical plane through the longitudinal axis of the training apparatus, said elbow or forearm rest portions being arranged behind and below the main holding portion, j. wherein the foot plates have a first surface which is essentially parallel to the longitudinal axis of the floating beam to which the foot plates is connected and a second surface, said second surface arranged behind the first surface and said second surface forming an angle (A) of between 110 and 160 degrees to the first surface.

2. The multi-functional training apparatus according to claim 1, wherein the forearm or elbow rest portions comprise a padded portion.

3. The multi-functional training apparatus according to claim 1, wherein the forearm or elbow rest portions are formed with a flat or concave upper surface to support the elbows or forearms of the user in a stable position laterally.

4. The multi-functional training apparatus according to claim 1, wherein the forearm or elbow rest portions are arranged to be soft so as to adapt to the shape of the users forearms or elbows to hold the forearms or elbows stably in place.

5. The multi-functional training apparatus according to claim 1, wherein vertical distance between the gripping portion of the first and second handles and the forearm rest portions is greater than 350 mm.

6. The multi-functional training apparatus according to claim 1, wherein the horizontal distance between the forearm or elbow rest portions is greater than or equal to the maximum horizontal width of the main holding portion.

7. The multi-functional training apparatus according to claim 1, wherein the elbow or forearm rest portions are arranged at or ahead of the rearmost position of the first and second moving handles.

8. The multi-functional training apparatus according to claim 1, wherein the stationary handle portion comprises a secondary holding portion which is arranged behind the elbow or forearm rest portions.

9. The multi-functional training apparatus according to claim 1, wherein the main holding portion is arranged such that the ratio of a) the vertical distance between an upper portion of the main holding portion and the rear portion of one of the foot plates in its rearmost position to b) the horizontal distance between the upper portion of the main holding portion and the rear portion of the foot plate in its rearmost position is less than 1.

10. The multi-functional training apparatus according to claim 1, wherein ratio of c) the vertical dimension from the rearmost portion of the foot plate in its rearmost position to the forearm rest portion to d) the horizontal dimension from the rearmost portion of the foot plate in its rearmost position to the forearm rest portion is less than or equal to 1.

11. The multi-functional training apparatus according to claim 1, wherein the maximum horizontal width of the main holding portion is less than the minimum horizontal distance between the first and second moving handles.

12. The multi-functional training apparatus according to claim 1, wherein the minimum horizontal distance between the first and second moving handles at the height of the main holding portion is greater than 500 mm.

13. The multi-functional training apparatus according to claim 1, wherein the rotation of the rotating member is resisted by a controlled variable resistance device.

* * * * *